US009801515B2

(12) United States Patent
Kim et al.

(10) Patent No.: US 9,801,515 B2
(45) Date of Patent: Oct. 31, 2017

(54) ROBOT CLEANER

(71) Applicant: LG ELECTRONICS INC., Seoul (KR)

(72) Inventors: Jongsu Kim, Seoul (KR); Hwang Kim, Seoul (KR); Sungil Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/376,880

(22) Filed: Dec. 13, 2016

(65) Prior Publication Data

US 2017/0086632 A1 Mar. 30, 2017

Related U.S. Application Data

(62) Division of application No. 14/755,772, filed on Jun. 30, 2015, now Pat. No. 9,572,468.

(30) Foreign Application Priority Data

Sep. 24, 2014 (KR) ..... 10-2014-0127838

(51) Int. Cl.
*A47L 9/16* (2006.01)
*A47L 9/04* (2006.01)
(Continued)

(52) U.S. Cl.
CPC ..... *A47L 9/1641* (2013.01); *A47L 9/009* (2013.01); *A47L 9/0477* (2013.01);
(Continued)

(58) Field of Classification Search
CPC ..... A47L 9/16; A47L 9/1616; A47L 9/1691; A47L 9/1641; A47L 9/1683; A47L 9/009; A47L 2201/00
(Continued)

(56) References Cited

U.S. PATENT DOCUMENTS 7,749,294 B2 7/2010 Oh et al.
8,887,349 B2 * 11/2014 Lee ..... A47L 5/362 15/327.1
(Continued)

FOREIGN PATENT DOCUMENTS

CN 101108082 A 1/2008
EP 1 797 809 A2 6/2007
(Continued)

*Primary Examiner* — David Redding
(74) *Attorney, Agent, or Firm* — Birch, Stewart, Kolasch & Birch, LLP

(57) ABSTRACT

A robot cleaner includes a cleaner body, a suction unit, and a cyclone unit. The cyclone unit has a first suction opening and a second suction opening for sucking air, and a first cyclone and a second cyclone for passing air therethrough, the air having dust filtered therefrom by a centrifugal force. A first guiding member and a second guiding member extend upwardly from the suction unit toward the cyclone unit with an inclination angle, the first guiding member for connection between the suction unit and the first suction opening, and the second guiding member for connection between the suction unit and the second suction opening. A dust box communicated with a dust discharge opening is provided at a front side of the cyclone unit so as to collect dust filtered by the cyclone unit. The dust box is partially or wholly accommodated between the first and second guiding members.

19 Claims, 8 Drawing Sheets

(51) Int. Cl.
*A47L 9/28* (2006.01)
*A47L 9/00* (2006.01)

(52) U.S. Cl.
CPC ..... *A47L 9/1608* (2013.01); *A47L 9/1683* (2013.01); *A47L 9/2826* (2013.01); *A47L 9/2894* (2013.01); *A47L 2201/00* (2013.01)

(58) Field of Classification Search
USPC ..... 15/353
See application file for complete search history.

(56) References Cited

U.S. PATENT DOCUMENTS

| | | | |
|---|---|---|---|
| 2007/0137153 | A1 | 6/2007 | Oh et al. |
| 2013/0305483 | A1 | 11/2013 | Dyson et al. |
| 2013/0305484 | A1 | 11/2013 | Dyson et al. |
| 2014/0013538 | A1 | 1/2014 | Dyson et al. |
| 2014/0182627 | A1 | 7/2014 | Williams et al. |
| 2014/0196231 | A1 | 7/2014 | Park et al. |
| 2015/0208891 | A1 | 7/2015 | Jang et al. |
| 2015/0272414 | A1 | 10/2015 | Janzen et al. |

FOREIGN PATENT DOCUMENTS

| | | | |
|---|---|---|---|
| EP | 2 417 893 | A1 | 2/2012 |
| JP | 8-89451 | A | 4/1996 |
| KR | 10-2007-0064997 | A | 6/2007 |
| KR | 10-0809773 | B1 | 3/2008 |
| KR | 10-0959973 | B1 | 5/2010 |
| KR | 10-2014-0062215 | A | 5/2014 |
| WO | 2013/105431 | A1 | 7/2013 |

* cited by examiner

ROBOT CLEANER

CROSS-REFERENCE TO RELATED APPLICATION

This application is a Divisional of copending U.S. application Ser. No. 14/755,772, filed on Jun. 30, 2015, which claims the benefit under 35 U.S.C. §119(a) to Korean Application No. 10-2014-0127838, filed on Sep. 24, 2014, the contents of which are incorporated by reference herein in their entirety.

BACKGROUND OF THE DISCLOSURE

1. Field of the Disclosure

This specification relates to a robot cleaner, and more particularly, to a robot cleaner having a novel structure and arrangement.

2. Background of the Disclosure

Generally, robots have been developed for industrial use, and have managed some aspects of factory automation. As robots are applied to various fields recently, not only medical robots and space robots, but also home robots are being developed.

A representative of the home robot is a robot cleaner, a home electronic appliance capable of performing a cleaning operation by sucking dust on a floor (including foreign materials) while autonomously moving on a predetermined region.

Such a robot cleaner is provided with a chargeable battery, and is provided with an obstacle sensor for avoiding an obstacle while moving.

Generally, a robot cleaner is designed to have a low height in a vertical direction, so as to fit and clean under a lower side of furniture or other structure. Thus, a dust box of the robot cleaner often has a smaller capacity than that of a general cleaner.

In such robot cleaner, the dust box of a small capacity is easily filled with dust by repetitive cleanings. This may cause inconvenience to a user who has to frequently empty the dust box. Furthermore, in some cases, a suction force may be lowered due to accumulated dust.

SUMMARY OF THE DISCLOSURE

Therefore, an aspect of the detailed description is to provide a robot cleaner having a novel structure and arrangement.

Another aspect of the detailed description is to provide a robot cleaner having a dust box of a maximum capacity within a restricted space, by providing an efficient spatial arrangement.

To achieve these and other advantages and in accordance with the purpose of this specification, as embodied and broadly described herein, there is provided a robot cleaner, including: a cleaner body; a suction unit provided at a front side of the cleaner body, and configured to suck dust-contained air; a cyclone unit provided at a rear upper side of the suction unit, the cyclone unit having a first suction opening and a second suction opening for sucking air, and the cyclone unit having a first cyclone and a second cyclone for passing air therethrough, the air having dust filtered therefrom by a centrifugal force; a first guiding member and a second guiding member upwardly extending from the suction unit toward the cyclone unit with an inclination angle, the first guiding member for connection between the suction unit and the first suction opening, the second guiding member for connection between the suction unit and the second suction opening; and a dust box communicated with a dust discharge opening provided at a front side of the cyclone unit so as to collect dust filtered by the cyclone unit, the dust box partially or wholly accommodated between the first and second guiding members.

In an embodiment, the dust box may be disposed between the suction unit and the cyclone unit.

In an embodiment, the dust box may include a dust box body having the dust discharge opening, and forming a space to collect dust filtered by the cyclone unit; and a dust box cover coupled to the dust box body so as to open and close an opening of the dust box body.

In an embodiment, the dust box body may include a first region communicated with the dust discharge opening; and a second region downwardly extending from the first region, having a smaller cross-sectional area than the first region, and partially or wholly accommodated between the first and second guiding members.

In an embodiment, at least part of the first region may be disposed on the first and second guiding members.

In an embodiment, the first and second guiding members may be formed such that at least parts thereof are bent to enclose the second region at two sides.

In an embodiment, the dust box cover may be disposed with an inclination angle such that at least part thereof faces the dust discharge opening.

In an embodiment, the first cyclone and the second cyclone may be disposed close to the first suction opening and the second suction opening, respectively.

In an embodiment, the first and second cyclones may be disposed to face each other.

In an embodiment, the robot cleaner may further include a fan unit provided at a rear lower side of the cyclone unit, connected to the cyclone unit, and configured to discharge dust-filtered air externally of the robot cleaner.

In an embodiment, the cyclone unit may be coupled onto the fan unit so as to be spaced from a bottom surface of the cleaner body.

In an embodiment, the fan unit may include a first fan and a second fan configured to suck dust-filtered air and to discharge it to outside; a first communication member configured to guide air introduced into an inner space of the first cyclone to the first fan; and a second communication member configured to guide air introduced into an inner space of the second cyclone to the second fan.

In an embodiment, the robot cleaner may further include a driving unit disposed between the first and second fans, and configured to generate a suction force by driving the first and second fans.

According to another aspect of the present invention, there is provided a robot cleaner, including: a suction unit configured to suck dust-contained air; a cyclone unit provided at a rear side of the suction unit, and configured to filter dust from air sucked thereto through the suction unit by a centrifugal force; a dust box communicated with a dust discharge opening provided at a front side of the cyclone unit so as to collect dust filtered by the cyclone unit; and a fan unit connected to the cyclone unit, and configured to discharge dust-filtered air to outside, wherein the cyclone unit is coupled onto the fan unit such that the dust box has a predetermined depth, the dust box disposed at a front upper side of the fan unit and connected to the cyclone unit.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Figure 1:
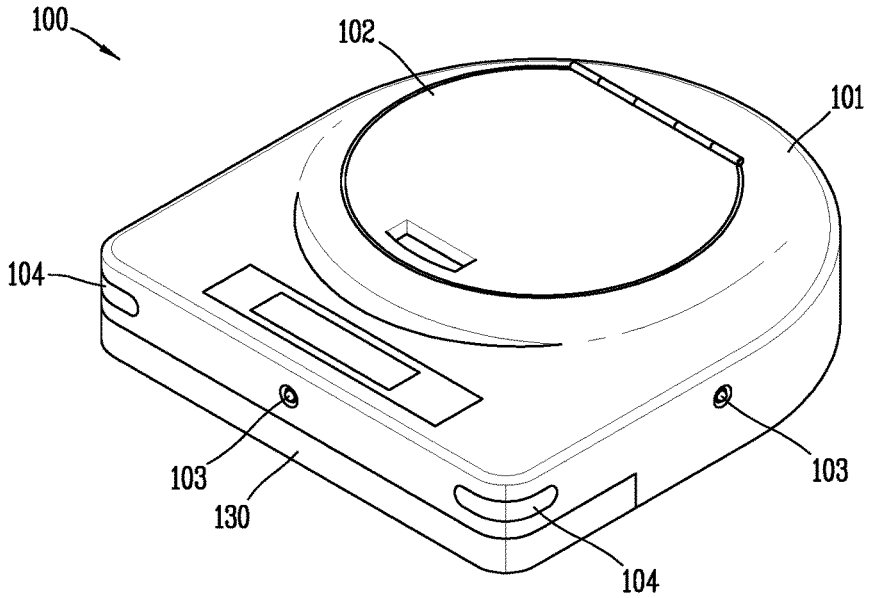
FIG. 1 is a perspective view of a robot cleaner according to the present invention.

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Where particular elements are described herein with respect to right and left sides of the robot cleaner, and their illustration with reference numerals has been shown only on the right side, it will be understood that the particular elements not shown on the left side correspond to the elements shown on the right side.

Figure 2:
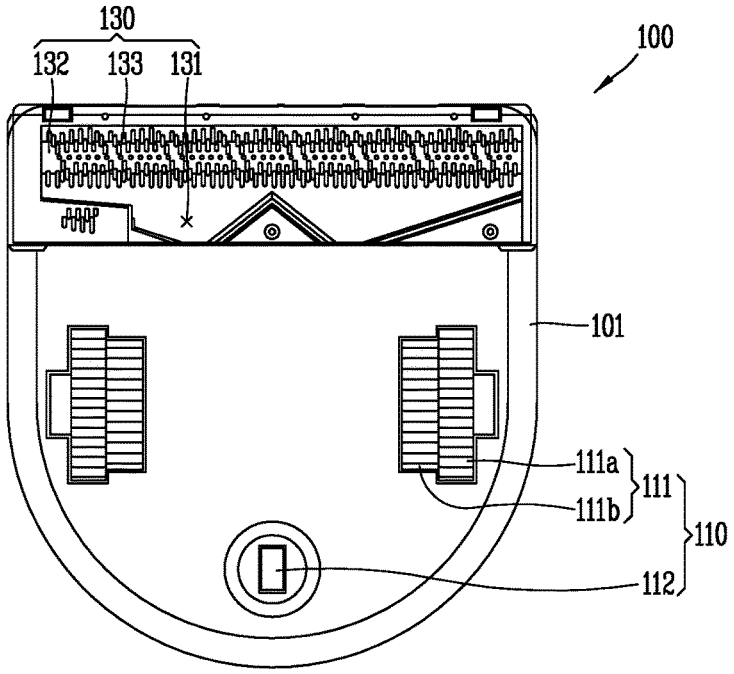
FIG. 2 is a bottom view of the robot cleaner of FIG. 1.

FIG. 1 is a perspective view of a robot cleaner 100 according to the present invention, and FIG. 2 is a bottom view of the robot cleaner 100 of FIG. 1.

Referring to FIGS. 1 and 2, the robot cleaner 100 performs a function to clean a floor by sucking dust (including foreign materials) on the floor, while autonomously moving on a predetermined region.

The robot cleaner 100 includes a cleaner body 101 for performing a moving function, a controller and a moving unit 110.

The cleaner body 101 is configured to accommodate components therein, and to move on a floor by the moving unit 110. A controller for controlling an operation of the robot cleaner 100, a battery for supplying power to the robot cleaner 100, an obstacle sensor 103 for avoiding an obstacle while moving, a damper 104 for absorbing a shock when colliding with an obstacle, etc. may be accommodated in or mounted to the cleaner body 101.

The moving unit 110 is configured to move (or rotate) the cleaner body 101 back and forth or right and left, and is provided with main wheels 111 and a supplementary wheel 112.

The main wheels 111 are provided at two sides of the cleaner body 101, are configured to be rotatable to one direction or another direction according to a control signal. The main wheels 111 may be configured to be independently driven. For instance, each of the main wheels 111 may be driven by a different motor.

Each of the main wheels 111 may be composed of wheels 111*a* and 111*b* having different radiuses with respect to a rotation shaft. Under such configuration, in a case where the main wheel 111 moves up on an obstacle such as a bump, at least one of the wheels 111*a* and 111*b* contacts the obstacle. This can prevent idling of the main wheel 111.

The supplementary wheel 112 is configured to support the cleaner body 101 together with the main wheels 111, and to supplement movement of the cleaner body by the main wheels 111.

Besides the aforementioned moving function, the robot cleaner 100 is provided with its own cleaning function. The present invention provides the robot cleaner 100 having an enhanced cleaning function by effectively separating dust from sucked air.

Hereinafter, the robot cleaner will be explained in more detail with reference to FIGS. 3 to 5.

Figure 3:
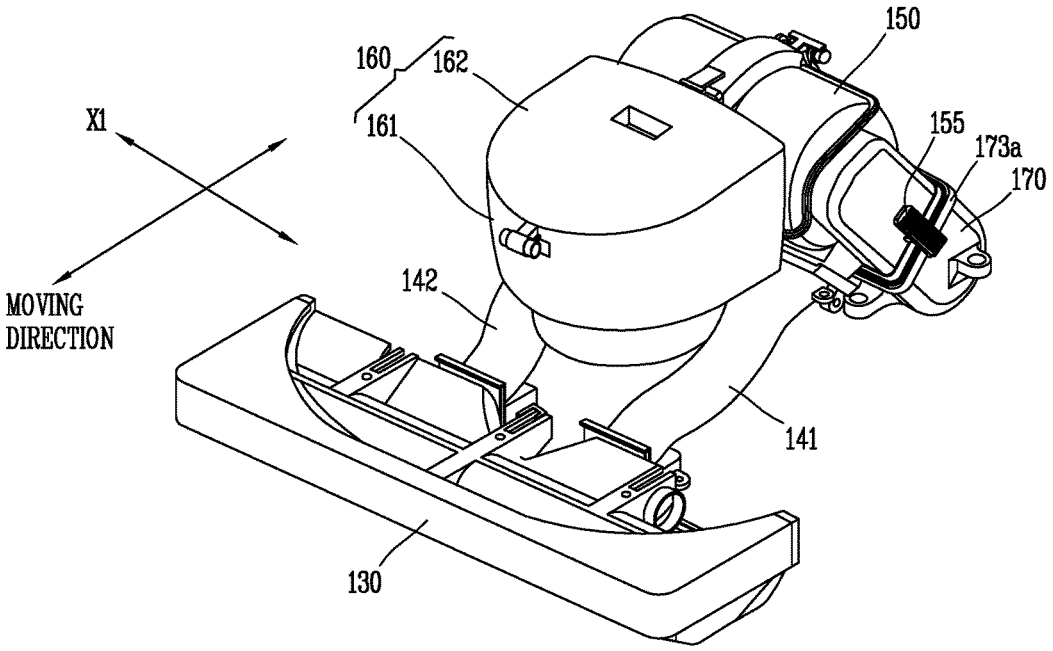
FIG. 3 is a conceptual view illustrating main components inside the robot cleaner of FIG. 1.
Figure 4:
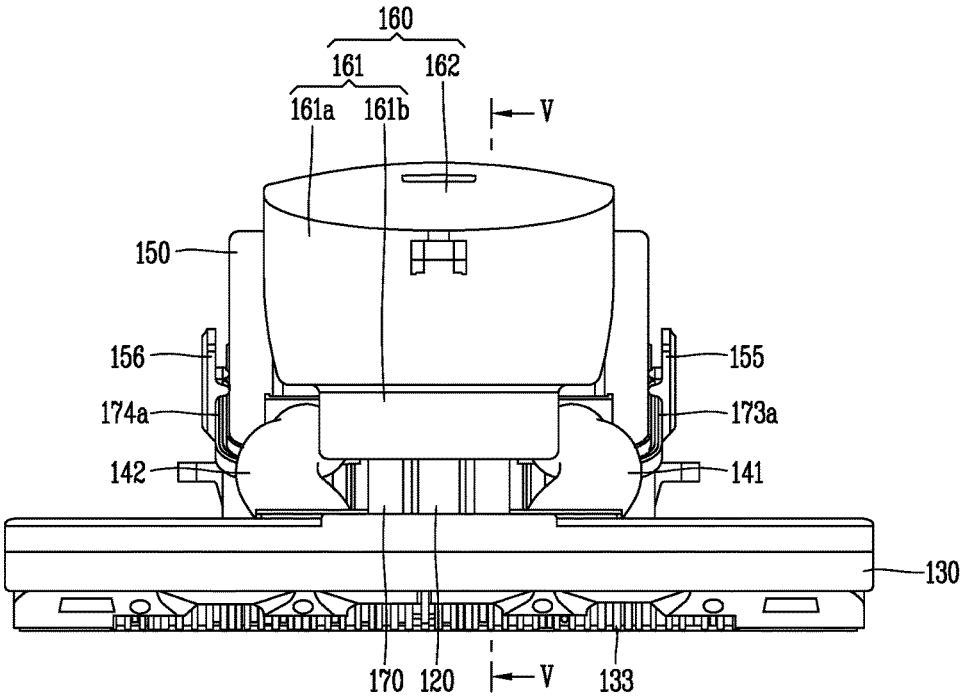
FIG. 4 is a front view of the robot cleaner of FIG. 3.
Figure 5:
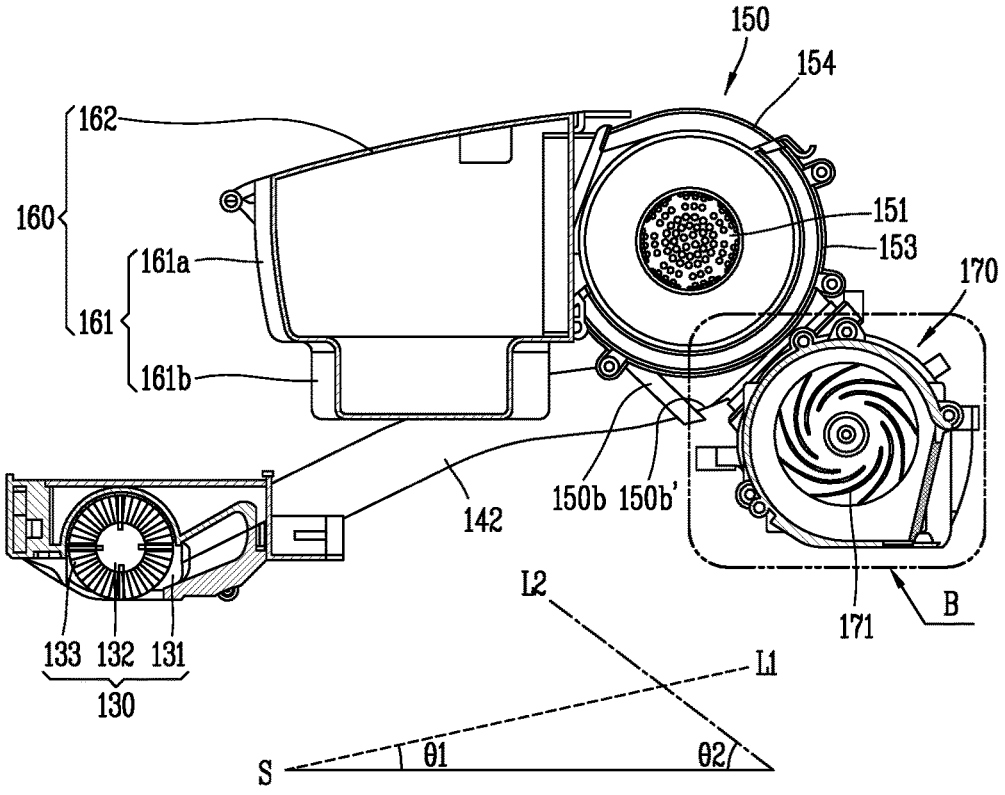
FIG. 5 is a sectional view taken along line 'V-V' in FIG. 4.

FIG. 3 is a conceptual view illustrating main components inside the robot cleaner 100 of FIG. 1, FIG. 4 is a front view of the robot cleaner 100 of FIG. 3, and FIG. 5 is a sectional view taken along line 'V-V' in FIG. 4.

Referring to FIGS. 3 to 5, the robot cleaner 100 includes a driving unit 120, a suction unit 130, a first guiding member 141, a second guiding member 142, and a cyclone unit 150.

The driving unit 120 is provided with a motor mounted to the cleaner body 101 and generating a driving force. The motor is configured to generate a suction force for sucking dust-contained air on a floor, by rotating a first fan 171 and a second fan 172 to be explained later.

The suction unit 130 is provided at a bottom portion of the cleaner body 101, and is configured to suck dust-contained air on a floor by the driving unit 120. The suction unit 130 may be arranged at a front side of the cleaner body 101, and may be detachably mounted to the cleaner body 101.

Referring to FIG. 5, the suction unit 130 includes a suction opening 131, a roller 132 and a brush 133.

The suction opening 131 may be formed to extend in a lengthwise direction of the suction unit 130. The roller 132 is rotatably installed at the suction opening 131, and the brush 133 is mounted to an outer circumferential surface of the roller 132. The brush 133 is configured to sweep up dust on a floor to the suction opening 131. The brush 133 may be formed of various materials including a fibrous material, an elastic material, etc.

The first guiding member 141 and the second guiding member 142 may be provided between the suction unit 130 and the cyclone unit 150, thereby connecting the suction unit 130 and the cyclone unit 150 to each other. The first guiding member 141 and the second guiding member 142 are spaced from each other. First ends of the first and second guiding members 141 and 142 coupled to the suction unit 130 may be fixed to the cleaner body 101.

Air sucked through the suction unit 130 is introduced into the cyclone unit 150 in a diverged manner, through the first and second guiding members 141 and 142. Such a configuration is advantageous in that air sucking efficiency is enhanced, compared to a case where a single guiding member is provided.

The first and second guiding members 141 and 142 may be disposed to be upwardly inclined toward the cyclone unit 150, so as to extend from the suction unit 130 toward the cyclone unit 150 (specifically, a first suction opening 150*a* and a second suction opening 150*b*). The cyclone unit 150 is arranged at a rear upper side of the suction unit 130.

The cyclone unit 150 may be provided with a cylindrical inner circumferential surface, and may be longitudinally-formed along one direction (X1). That is, the cyclone unit 150 may have an approximate cylindrical shape. The one direction (X1) may be a direction perpendicular to a moving direction (forward or backward direction) of the robot cleaner 100.

The cyclone unit 150 is configured to filter dust from air sucked thereto through the suction unit 130. More specifically, air sucked into the cyclone unit 150 is rotated along an inner circumferential surface of the cyclone unit 150. During such a process, dust is collected into a dust box 160 communicated with a dust discharge opening 150*e*, and dust-filtered air is introduced into a first cyclone 151 and a second cyclone 152.

The dust discharge opening 150*e* is formed at a front part of the cyclone unit 150. The dust discharge opening 150*e* may be formed between the first suction opening 150*a* and the second suction opening 150*b* (or between the first cyclone 151 and the second cyclone 152), i.e., at a central portion of the cyclone unit 150. With this structure, dust included in air introduced into two sides of the cyclone unit 150 through the first and second suction openings 150*a* and 150*b*, rotates along an inner circumferential surface of the cyclone unit 150, toward a central part from an end part of the cyclone unit 150. Then the dust is collected into the dust box 160 through the dust discharge opening 150*e*.

The dust box 160 is connected to the cyclone unit 150, and is configured to collect dust filtered by the cyclone unit 150. In this embodiment, the dust box 160 is disposed between the suction unit 130 and the cyclone unit 150.

The dust box 160 is detachably mounted to the cyclone unit 150 so as to be separable from the cleaner body 101. Such structure will be explained in more detail. When a cover 102 openably-coupled to the cleaner body 101 is open, the dust box 160 may be in a separable state by being exposed to the outside. The dust box 160 may be configured to be visible to the outside, thereby forming an appearance of the robot cleaner 100 together with the cleaner body 101. In this case, a user can check the amount of dust accumulated in the dust box 160 without opening the cover 102.

The dust box 160 may include a dust box body 161 and a dust box cover 162. The dust box body 161 forms a space for collecting dust filtered by the cyclone unit 150, and the dust box cover 162 is coupled to the dust box body 161 so as to open and close an opening of the dust box body 161. For instance, the dust box cover 162 may be configured to open and close the opening of the dust box body 161, by being hinge-coupled to the dust box body 161.

The dust discharge opening 150*e* may be provided at the dust box body 161. However, the present invention is not limited to this. The dust discharge opening 150*e* may be also formed at the dust box cover 162 according to a modified design.

As aforementioned, the dust box 160 connected to the cyclone unit 150 may be formed to have a predetermined depth, since the cyclone unit 150 is arranged at an upper side of the suction unit 130. For efficient spatial arrangement, at least part of the dust box 160 may be accommodated in a space between the first guiding member 141 and the second guiding member 142.

In this embodiment, the dust box body 161 includes a first portion 161*a* and a second portion 161*b* having different cross-sectional areas.

More specifically, the first portion 161*a* may be communicated with the dust discharge opening 150*e*, and at least part of the first portion 161*a* may be disposed on the first and second guiding members 141 and 142. As shown in FIG. 4, in this embodiment, two sides of the first portion 161*a* are disposed on the first and second guiding members 141 and 142.

The second portion 161*b* is formed to extend to a lower side of the first portion 161*a*, and to have a smaller cross-sectional area than the first portion 161*a*. Accordingly, at least part of the second portion 161 is accommodated in a space between the first and second guiding members 141 and 142. The first and second guiding members 141 and 142 may be formed such that at least part thereof is bent to enclose two sides of the second portion 161*b*.

With this structure, dust collected into the dust box 160 is firstly accumulated in the second portion 161*b*. In a modified embodiment, an inclined portion (not shown), inclined toward the second portion 161*b* so that dust can move to the second portion 161*b*, may be provided between the first portion 161*a* and the second portion 161*b*.

The dust box cover 162 may be arranged to be inclined so that at least part thereof can face the dust discharge opening 150*e*. With this structure, dust introduced into the dust box 160 through the dust discharge opening 150*e* can directly collide with the dust box cover 162 without being blown around, thereby being collected in the dust box body 161 (mainly, the second portion 161*b*).

A fan unit 170 may be connected to the cyclone unit 150, such that dust-filtered air is discharged to the outside. The fan unit 170 is configured to generate a suction force by being driven by the driving unit 120, and to finally discharge clean air to the outside.

The fan unit 170 may be fixed to the cleaner body 101, and may be provided at a rear lower side of the cyclone unit 150. For such an arrangement, in this embodiment, the cyclone unit 150 is coupled onto the fan unit 170 (specifically, a first communication member 173 and a second communication member 174), thereby being spaced from a bottom surface of the cleaner body 101.

As shown in FIG. 5, an arbitrary line (L1), which connects two ends of the first guiding member 141 or the second guiding member 142 to each other, has an inclination angle (θ1), from a bottom surface (S) of the cleaner body 101. An arbitrary line (L2), which connects the cyclone unit 150 and the fan unit 170 to each other, has an inclination angle (θ2), from the bottom surface (S) of the cleaner body 101. As such inclination angles (θ1 and θ2) are controlled, a volume of the dust box 160 may be variously designed.

Hereinafter, a detailed structure of the cyclone unit 150 and the fan unit 170 will be explained.

Figure 6:
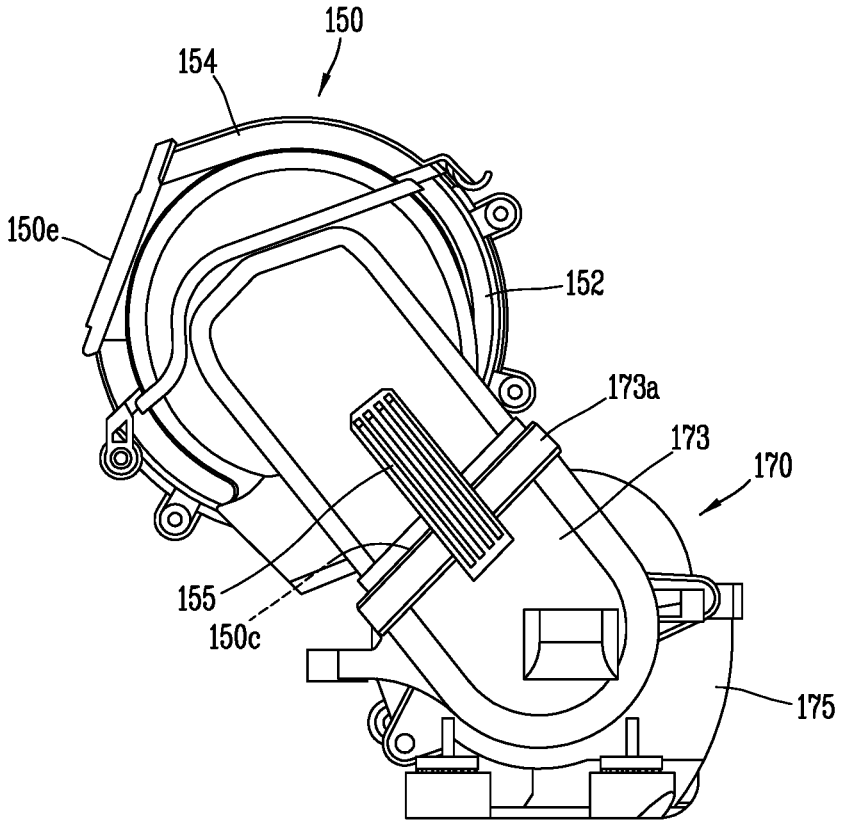
FIG. 6 is a side sectional view illustrating a cyclone unit and a fan unit separated from the robot cleaner of FIG. 3.
Figure 7A:
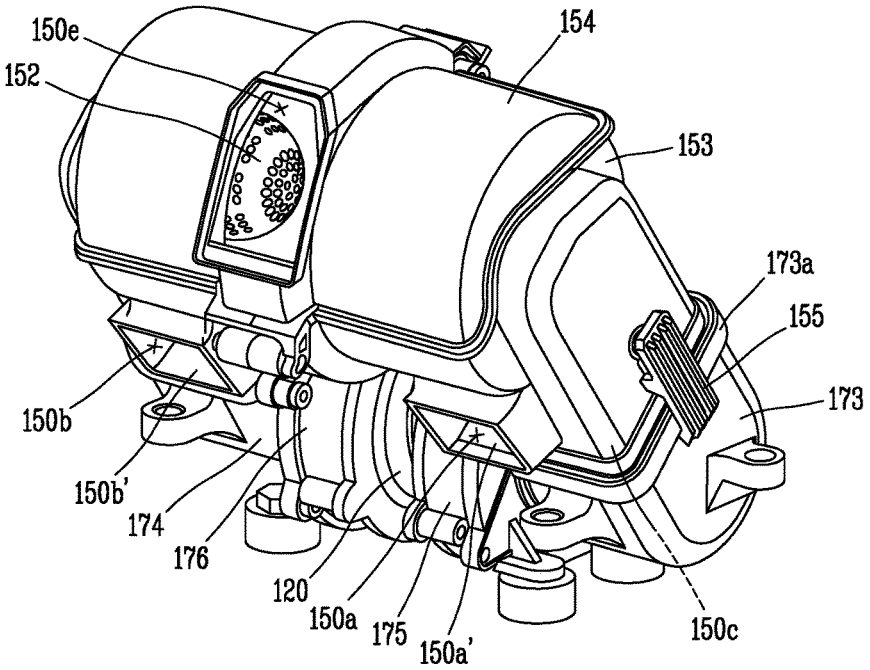
FIG. 7A is a perspective view of the cyclone unit and the fan unit of FIG. 6.

FIG. 6 is a side sectional view illustrating the cyclone unit 150 and the fan unit 170 separated from the robot cleaner 100 of FIG. 3. FIG. 7A is a perspective view of the cyclone unit 150 and the fan unit 170 of FIG. 6. The FIG. 7B is a conceptual view illustrating a state where a second case 154 of the cyclone unit 150 of FIG. 7A has been removed.

Figure 7B:
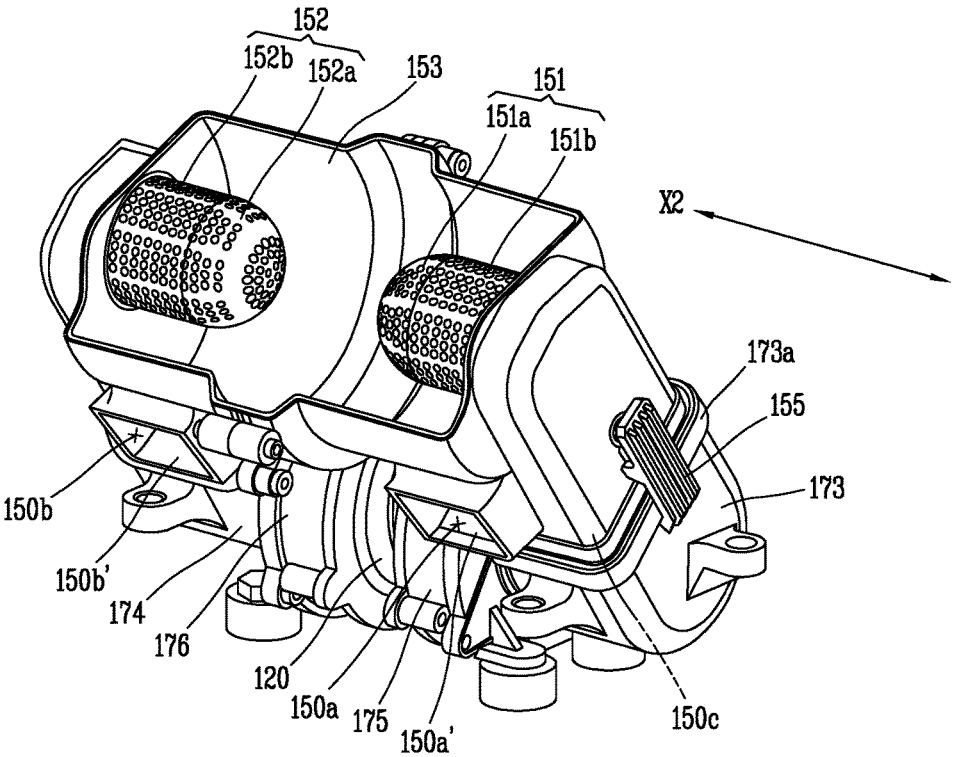
FIG. 7B is a conceptual view illustrating a state where a second case of the cyclone unit of FIG. 7A has been removed.

Referring to FIGS. 6 to 7B together with the aforementioned figures, the cyclone unit 150 is provided with the first suction opening 150*a* communicated with the first guiding member 141, and the second suction opening 150*b* communicated with the second guiding member 142. The first suction opening 150*a* and the second suction opening 150*b* may be formed at two sides of the cyclone unit 150, such that air introduced into the cyclone unit 150 through the first suction opening 150*a* and the second suction opening 150*b* rotates along an inner circumferential surface of the cyclone unit 150, toward a central part from an end part of the cyclone unit 150.

The cyclone unit 150 may further include a first suction guide 150*a*' and a second suction guide 150*b*' configured to guide air sucked to the cyclone unit 150 through the first suction opening 150*a* and the second suction opening 150*b* to an inner circumferential surface of the cyclone unit 150, respectively. The first suction guide 150*a*' is formed at the first suction opening 150*a* toward an inner circumferential surface of the cyclone unit 150, and the second suction guide 150*b*' is formed at the second suction opening 150*b* toward an inner circumferential surface of the cyclone unit 150.

The cyclone unit 150 is provided therein with the first cyclone 151 and the second cyclone 152, such that dust-filtered air is introduced into the first cyclone 151 and the second cyclone 152. The first cyclone 151 has a structure that an air passing hole 151*b* is formed at a protruding member 151*a* having an empty inner space, and the second cyclone 152 has a structure that an air passing hole 152*b* is formed at a protruding member 152*a* having an empty inner space. That is, dust cannot pass through the air passing holes 151*b* and 152*b*, whereas air can pass through the air passing holes 151*b* and 152*b* to thus be introduced into the inner spaces of the protruding members 151*a* and 152*a*.

As shown, the first cyclone 151 may be arranged close to the first suction opening 150*a*, and the second cyclone 152 may be arranged close to the second suction opening 150*b*. With this structure, air sucked into the cyclone unit 150 through the first suction opening 150*a* is mainly introduced into the first cyclone 151, and air sucked into the cyclone unit 150 through the second suction opening 150*b* is mainly introduced into the second cyclone 152. Thus, dust can be efficiently filtered from the sucked air, and the dust-filtered air can be more efficiently discharged from the cyclone unit 150.

The first and second cyclones 151 and 152 may be provided at two ends of the cyclone unit 150 in a facing manner. In this case, the first and second cyclones 151 and 152 may be formed to protrude along the same axis (X2). The axis (X2) may be perpendicular to a moving direction (forward or backward direction) of the robot cleaner 100. The axis (X2) may be identical to the aforementioned one direction (X1).

The first and second cyclones 151 and 152 may be arranged at central regions of two end portions of the cyclone unit 150 so as to have a preset separating distance from an inner circumferential surface of the cyclone unit 150. With this structure, dust can rotate along an inner circumferential surface of the cyclone unit 150, and dust-filtered air can be mainly introduced into the first and second cyclones 151 and 152.

Figure 8:
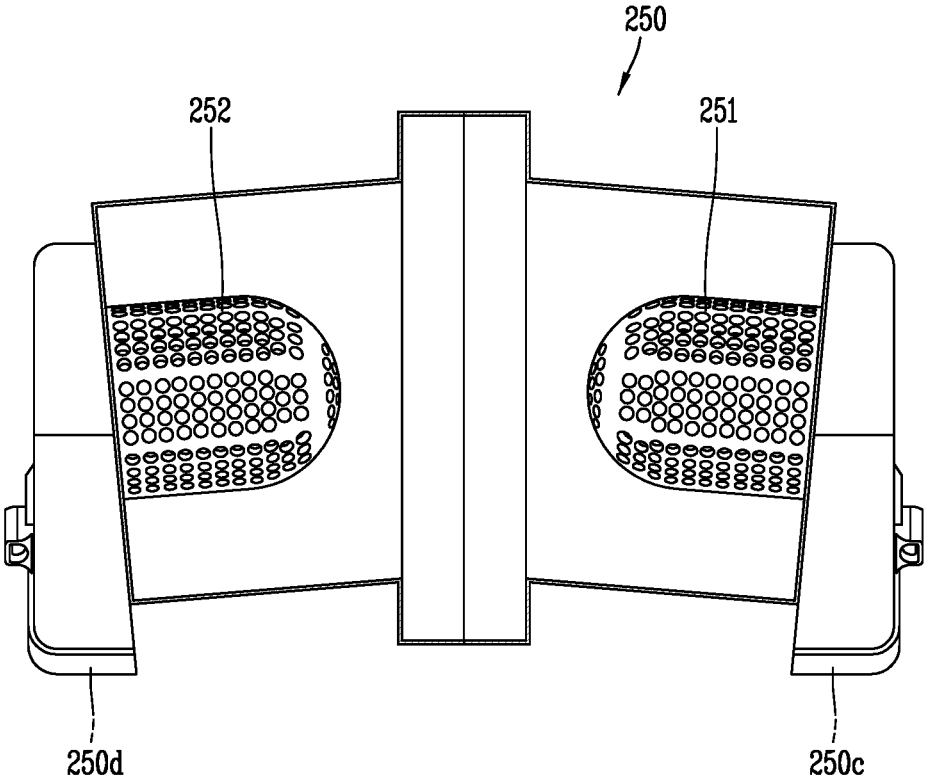
FIG. 8 is a conceptual view illustrating a modification example of the cyclone unit of FIG. 7A.

Referring to FIG. 8 illustrating a modification example of the cyclone unit 150 of FIG. 7A, a cyclone unit 250 may be configured so that air which has passed through first and second suction openings can be introduced toward a central part of the cyclone unit 250. With this structure, air introduced into the cyclone unit 250 can easily rotate toward a central part of the cyclone unit 250 from an end part of the cyclone unit 250.

In the drawings, the cyclone unit 250 is arranged so that a region for accommodating a first cyclone 251 and a region for accommodating a second cyclone 252 have a preset angle therebetween. The preset angle viewed from a front side may be 180° or less.

The first and second suction openings may be formed toward a central part of the cyclone unit 250 such that air is introduced into the central part of the cyclone unit 250. The first and second suction guides aforementioned with reference to the aforementioned embodiment may be formed to extend toward the central part of the cyclone unit 250.

Referring to FIGS. 6 and 7A, the cyclone unit 150 may include a first case 153 and a second case 154. The first case 153 is provided with the first and second suction openings 150*a* and 150*b* and the first and second cyclones 151 and 152, and is configured to be coupled to the first and second guiding members 141 and 142. The second case 154 is provided with a dust discharge opening, and is openably coupled to the first case 153. For instance, the second case 154 may be hinge-coupled to the first case 153, and may be configured to open and close the first case 153 by being rotated.

With this configuration, as the second case 154 is separated from the first case 153 or rotated, an inside of the cyclone unit 150 may be accessed. This is advantageous in that dust, collected in the air passing holes 151*b* and 152*b* of the first and second cyclones 151 and 152 without having passed therethrough, can be easily removed.

The cyclone unit 150 may further include a first discharge opening 150*c* and a second discharge opening (not shown) communicated with inner spaces of the protruding members 151*a* and 152*a* of the first and second cyclones 151 and 152, respectively, so that dust-filtered air can be discharged. The first discharge opening 150*c* and the second discharge opening may be provided at two sides of the cyclone unit 150. Although the second discharge opening is not shown in the drawings, the second discharge opening is a mirror image of the first discharge opening shown in FIG. 7A.

The fan unit 170 may be connected to each of the first discharge opening 150*c* and the second discharge opening, such that dust-filtered air is discharged to the outside.

Hereinafter, a detailed structure of the fan unit 170 will be explained in more detail with reference to FIGS. 9A to 10.

Figure 9A:
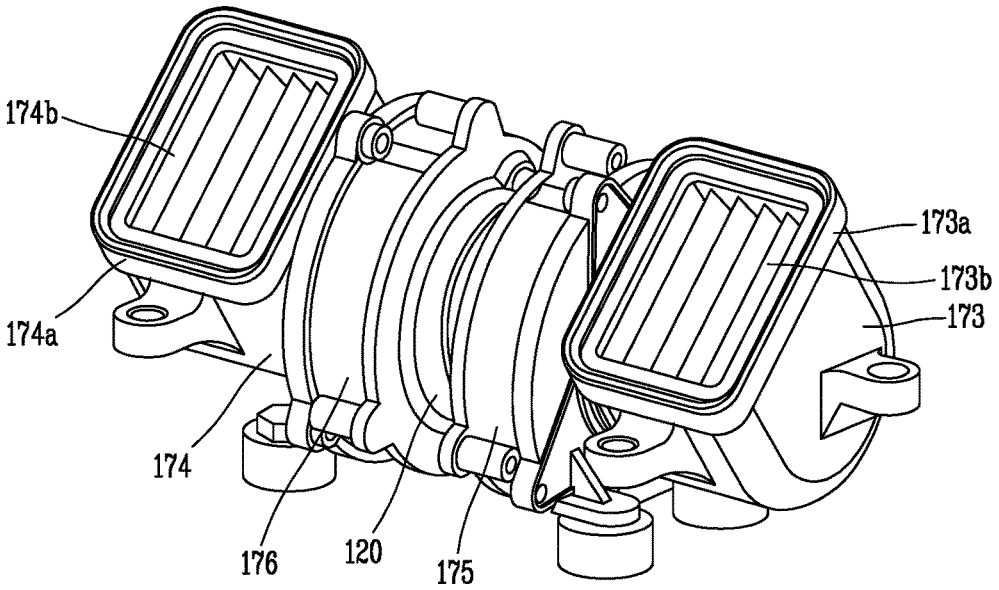
FIG. 9A is a perspective view of the fan unit shown in FIG. 6.
Figure 9B:
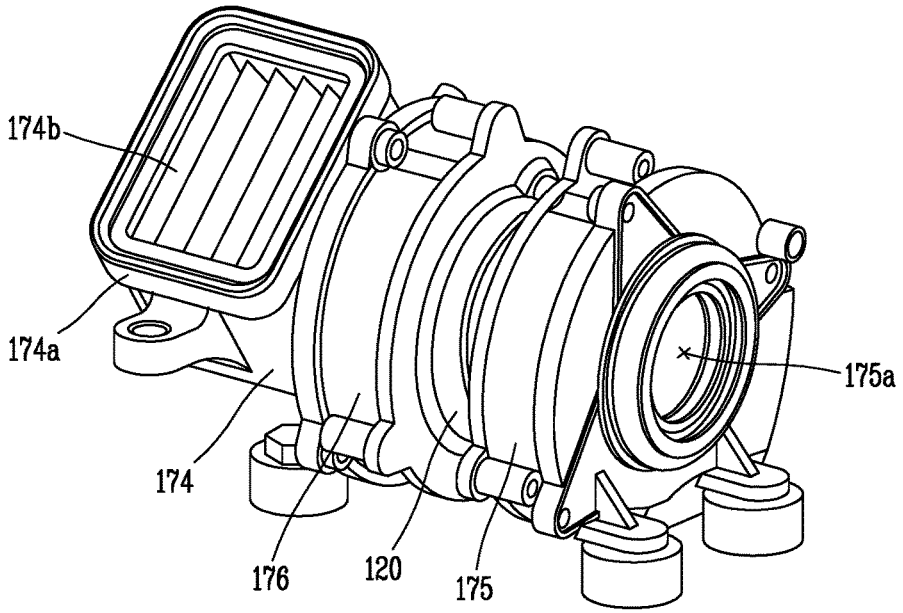
FIG. 9B is a conceptual view illustrating a state where a first communication member has been removed from the fan unit of FIG. 9A.
Figure 9C:
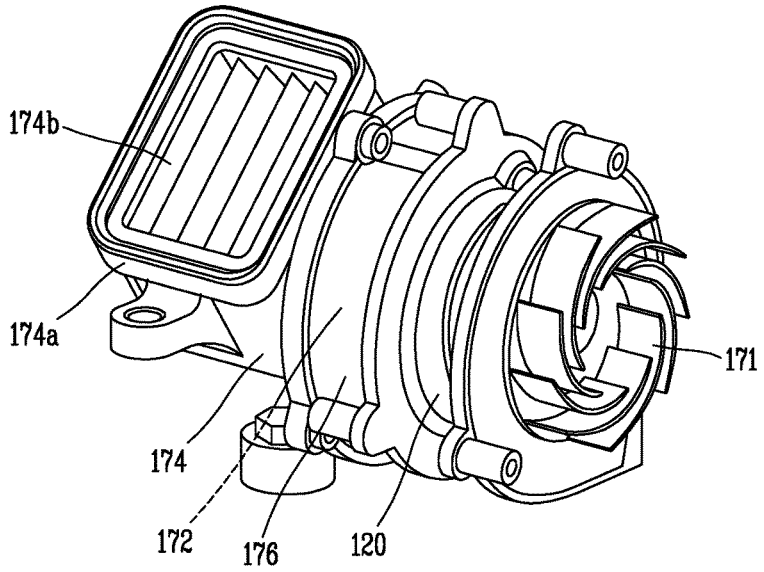
FIG. 9C is a conceptual view illustrating a state where a first fan cover has been removed from the fan unit of FIG. 9B.
Figure 10:
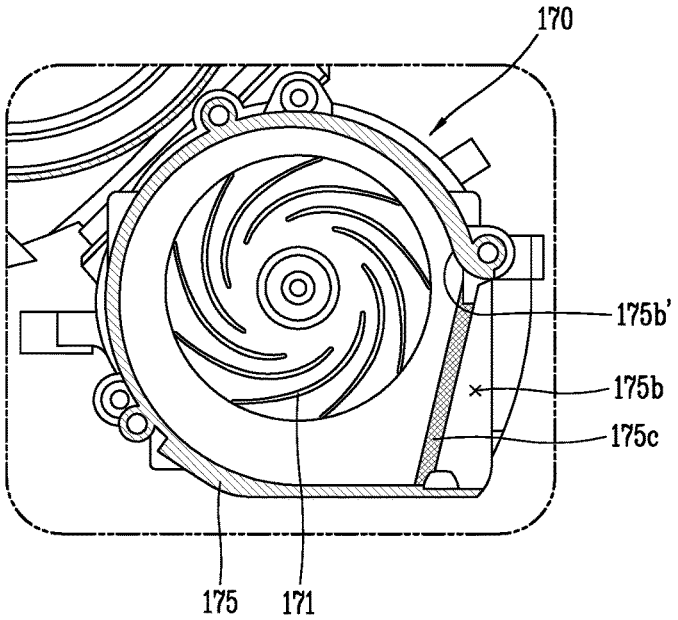
FIG. 10 is an enlarged view of part 'B' shown in FIG. 5.

FIG. 9A is a perspective view of the fan unit 170 shown in FIG. 6, FIG. 9B is a conceptual view illustrating a state where a first communication member 173 has been removed from the fan unit 170 of FIG. 9A, and FIG. 9C is a conceptual view illustrating a state where a first fan cover 175 has been removed from the fan unit 170 of FIG. 9B. FIG. 10 is an enlarged view of part 'B' shown in FIG. 5.

Referring to the above figures with reference to the aforementioned figures, the fan unit 170 includes a first fan 171, a second fan 172, a first communication member 173 and a second communication member 174. Although the details of the second fan are not shown in the drawings, the second fan is a mirror image of the first fan shown in FIG. 9C.

The first and second fans 171 and 172 are configured to suck dust-filtered air and to discharge the air to the outside while being rotated by the driving unit 120. Each of the first and second fans 171 and 172 may be formed as a volute fan.

In this embodiment, the driving unit 120 is disposed between the first and second fans 171 and 172, and the first and second fans 171 and 172 are driven to generate a suction force. However, the present invention is not limited to this. That is, an installation position of the driving unit 120 may be changed.

The first communication member 173 is configured to connect the first discharge opening 150*c* of the cyclone unit 150 with the first fan 171, and thus to guide air introduced into the inner space of the first cyclone 151 into the first fan 171. Likewise, the second communication member 174 is configured to connect the second discharge opening of the cyclone unit 150 with the second fan 172, and thus to guide air introduced into the inner space of the second cyclone 152 into the second fan 172.

As previously mentioned (refer to FIGS. 6 to 7B), in a case where the cyclone unit 150 includes the first case 153 and the second case 154, the first case 153 may be provided with the first discharge opening 150*c* and the second discharge opening, and may be coupled to each of the first and second communication members 173 and 174.

A first coupling member 155 for coupling with the first communication member 173, and a second coupling member 156 (see FIG. 4) for coupling with the second communication member 174 may be provided at two sides of the first case 153.

For instance, each of the first and second coupling members 155 and 156 may include a hook and an elastic member. More specifically, the hooks are rotatably coupled to two sides of the first case 153, and are locked by the first and second communication members 173 and 174. The elastic members are configured to elastically press the hooks so that a locked state of the hooks to the first and second communication members 173 and 174 can be maintained. The first and second communication members 173 and 174 may be provided with locking protrusions 173*a* and 174*a* configured to lock the hooks so that the first case 153 can be prevented from being separated from the first and second communication members 173 and 174.

Coupling of the first case 153 with the first and second communication members 173 and 174 is not limited to the above coupling. That is, the first case 153 may be coupled with the first and second communication members 173 and 174 in various manners without an additional coupling member, e.g., by using a locking structure or by bonding.

Fine dust filters 173*b* and 174*b*, configured to filter fine dust from dust-filtered air, may be mounted to the first and second communication members 173 and 174. HEPA filters may be used as the fine dust filters 173*b* and 174*b*. For replacement, the fine dust filters 173*b* and 174*b* may be configured to be exposed to outside when the cyclone unit 150 is separated from the first and second communication members 173 and 174.

The fan unit 170 may further include a first fan cover 175 for accommodating the first fan 171 therein, and a second fan cover 176 for accommodating the second fan 172 therein. The first fan cover 175 is provided with a first air inlet 175*a* in a direction of a rotation shaft of the first fan 171, and is provided with a first air outlet 175*b* in a radius direction of the first fan 171. Likewise, the second fan cover 176 is provided with a second air inlet (not shown) in a direction of a rotation shaft of the second fan 172, and is provided with a second air outlet (not shown) in a radius direction of the second fan 172. Although the second air inlet and the second air outlet are not shown in the drawings, the second air inlet is a mirror image of the first air inlet shown in FIG. 9B, and the second air outlet is a mirror image of the first air outlet shown in FIG. 10.

A mechanism to suck and discharge air according to such structure will be explained in more detail. Dust-filtered air is introduced into the first fan cover 175 through the first air inlet 175*a* by a suction force due to rotation of the first fan 171. Then the air is moved to a side direction by rotation of the first fan 171 implemented as a volute fan, and is discharged out through the first air outlet 175*b*. Such a mechanism may be equally applied to processes to suck and discharge air by rotation of the second fan 172.

In order to reduce noise generated when the first and second fans 171 and 172 are driven and in order to increase an air volume, the following structure may be applied. Hereinafter, this will be explained in more detail with reference to FIG. 10.

A preset gap may be maintained between an inner circumferential surface of the first fan cover 175 and an end portion of the first fan 171 disposed close to the first fan cover 175. Likewise, a preset gap may be maintained between an inner circumferential surface of the second fan cover 176 and an end portion of the second fan 172 disposed close to the second fan cover 176.

The first fan cover 175 may be provided with a first exhaustion guide 175*b*' for guiding smooth exhaustion of dust-filtered air, and the second fan cover 176 may be provided with a second exhaustion guide (not shown). More specifically, the first exhaustion guide 175*b*' may extend from an inner circumferential surface of the first fan cover 175 toward the first air outlet 175*b*, in a rounded shape. Although the second exhaustion guide is not shown in the drawings, the second exhaustion guide is a mirror image of the first exhaustion guide shown in FIG. 10.

A first exhaustion hole (not shown) corresponding to the first air outlet 175*b*, and a second exhaustion hole (not shown) corresponding to the second air outlet may be formed at the cleaner body 101.

A fine dust filter 175*c* may be mounted to at least one of the first fan cover 175 and the cleaner body 101, such that cleaner air is finally discharged to the outside. A HEPA filter may be used as the fine dust filter 175*c*.

The fine dust filter 175*c* is mounted to at least one of the first air outlet 175*b* and the first exhaustion hole in a covering manner, and is configured to filter fine dust from dust-filtered air. Likewise, the fine dust filter 175*c* may be mounted to at least one of the second fan cover 176 and the cleaner body 101.

The robot cleaner according to the present invention can have the following advantages.

Firstly, since a single cyclone unit is provided with a plurality of cyclones therein, dust can be effectively filtered from sucked air. For an enhanced dust filtering function, a plurality of guiding members are provided to correspond to a plurality of cyclones, so that air sucked through a suction unit can be introduced into the cyclone unit. A fan unit is configured so that air which has passed through the plurality of cyclones can be discharged to the outside. With this structure, dust can be more effectively filtered from sucked air, and dust-filtered air can be discharged to the outside, thereby enhancing a cleaning function of the robot cleaner.

Secondly, the robot cleaner according to the present invention is provided with a suction guide for guiding sucked air to an inner circumferential surface of the cyclone unit, and the exhaustion guide extending from an inner circumferential surface of a fan cover toward an air outlet. Accordingly, the robot cleaner can reduce noise when sucking and discharging air.

Thirdly, in the robot cleaner according to the present invention, large particle-sized dust is filtered from air by the cyclone unit, and then fine dust is filtered from dust-filtered air by a fine dust filter provided on at least one of an inlet side and an outlet side of the fan unit. Thus, cleaner air can be discharged to the outside of the robot cleaner.

Fourthly, the cyclone unit having the plurality of cyclones is arranged at a rear upper side of the suction unit, and a plurality of connection members extend from the suction unit toward the cyclone unit with an inclination angle, for connection between the suction unit and the cyclone unit. Also, the fan unit is provided at a rear lower side of the cyclone unit. With this new structure and arrangement, the robot cleaner can have an efficient spatial arrangement and an enhanced cleaning performance.

Fifthly, in a case where at least part of a dust box is accommodated in a space between the connection members, the dust box can have a larger capacity within the restricted space.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A robot cleaner, comprising:

a suction unit configured to suck dust-contained air from a floor surface;

a cyclone unit configured to filter dust from the dust-contained air sucked through the suction unit by using a centrifugal force, the cyclone unit comprising:

a first cyclone; and a second cyclone facing the first cyclone;

a fan unit configured to discharge dust-filtered air to an outside of the robot cleaner, the fan unit comprising:

a first fan configured to suck dust-filtered air and discharge the dust-filtered air to the outside;

a second fan configured to suck dust-filtered air and discharge the dust-filtered air to the outside;

a first communication member configured to guide air introduced into an inner space of the first cyclone to the first fan; and a second communication member configured to guide air introduced into an inner space of the second cyclone to the second fan; and a driving unit disposed between the first fan and the second fan, the driving unit being configured to generate a suction force by driving the first fan and the second fan.

2. The robot cleaner of claim 1, wherein the fan unit further comprises:

a first fine dust filter mounted to the first communication member and configured to filter fine dust; and a second fine dust filter mounted to the second communication member and configured to filter fine dust.

3. The robot cleaner of claim 1, wherein the fan unit further comprises:

a first fan cover configured to accommodate the first fan therein, the first fan cover including:

a first air inlet formed in a direction of a rotation shaft of the first fan; and a first air outlet formed in a radius direction of the first fan; and a second fan cover configured to accommodate the second fan therein, the second fan cover including:

a second air inlet formed in a direction of a rotation shaft of the second fan; and a second air outlet formed in a radius direction of the second fan.

4. The robot cleaner of claim 3, wherein the first fan cover further includes a first exhaustion guide extending from an inner circumferential surface of the first fan cover, the first exhaustion guide having a rounded shape toward the first air outlet so that noise is reduced when dust-filtered air is discharged outside of the first fan cover, and wherein the second fan cover further includes a second exhaustion guide extending from an inner circumferential surface of the second fan cover, the second exhaustion guide having a rounded shape toward the second air outlet so that noise is reduced when dust-filtered air is discharged outside of the second fan cover.

5. The robot cleaner of claim 3, wherein the fan unit further comprises:

a first fine dust filter mounted to the first air outlet; and a second fine dust filter mounted to the second air outlet.

6. The robot cleaner of claim 1, further comprising:

a first guiding member extending upwardly from the suction unit toward the cyclone unit at an inclination angle, the first guiding member providing a first flow path for dust-contained air between the suction unit and the cyclone unit; and a second guiding member extending upwardly from the suction unit toward the cyclone unit at an inclination angle and spaced apart from the first guiding member, the second guiding member providing a second flow path for dust-contained air between the suction unit and the cyclone unit.

7. The robot cleaner of claim 6, wherein the first guiding member and the second guiding member are inclined at a first angle with respect to the floor surface, wherein a line interconnecting a central axis of the cyclone unit and a central axis of the driving unit is inclined at a second angle with respect to the floor surface, and wherein the first angle is less than the second angle.

8. The robot cleaner of claim 6, wherein the cyclone unit further comprises:

a first suction opening communicated with the first guiding member; and a second suction opening communicated with the second guiding member, and wherein the first cyclone is disposed close to the first suction opening, and the second cyclone is disposed close to the second suction opening.

9. The robot cleaner of claim 8, wherein the first cyclone and the second cyclone are disposed at central portions of both ends of the cyclone unit so as to have a preset separation distance from an inner circumferential surface of the cyclone unit.

10. The robot cleaner of claim 8, wherein the cyclone unit further comprises:

a first suction guide extending from the first suction opening toward an inner circumferential surface of the cyclone unit; and a second suction guide extending from the second suction opening toward the inner circumferential surface of the cyclone unit, whereby sucked air is guided to the inner circumferential surface of the cyclone unit.

11. The robot cleaner of claim 1, further comprising:

a dust box communicated with a dust discharge opening provided at a front side of the cyclone unit and configured to collect dust filtered by the cyclone unit, wherein the cyclone unit is provided at a front upper side of the fan unit such that the dust box connected to the cyclone unit has a predetermined depth.

12. The robot cleaner of claim 11, further comprising:

a first guiding member extending upwardly from the suction unit toward the cyclone unit at an inclination angle, the first guiding member providing a first flow path for dust-contained air between the suction unit and the cyclone unit; and a second guiding member extending upwardly from the suction unit toward the cyclone unit at an inclination angle and spaced apart from the first guiding member, the second guiding member providing a second flow path for dust-contained air between the suction unit and the cyclone unit, wherein at least a portion of the dust box is accommodated between the first guiding member and the second guiding member.

13. The robot cleaner of claim 11, wherein the dust box is disposed between the suction unit and the cyclone unit.

14. The robot cleaner of claim 11, wherein the dust box comprises:

a dust box body communicated with the dust discharge opening of the cyclone unit, the dust box body forming a space to collect the dust filtered by the cyclone unit, the dust box comprising:

a first region communicated with the dust discharge opening of the cyclone unit; and a second region located below the first region, the second region having a smaller cross-sectional area than the first region; and a dust box cover coupled to the dust box body and configured to open and close an opening of the dust box body, and wherein at least a portion of second region is accommodated between the first guiding member and the second guiding member.

15. The robot cleaner of claim 14, wherein at least a portion of the first region is disposed on the first guiding member and the second guiding member.

16. A robot cleaner, comprising:

a suction unit configured to suck dust-contained air from a floor surface;

a cyclone unit configured to filter dust from the dust-contained air sucked through the suction unit by using a centrifugal force, the cyclone unit comprising:

a first cyclone; and a second cyclone facing the first cyclone;

a fan unit configured to discharge dust-filtered air to an outside of the robot cleaner, the fan unit comprising:

a first fan configured to suck dust-filtered air and discharge the dust-filtered air to the outside;

a second fan configured to suck dust-filtered air and discharge the dust-filtered air to the outside;

a first communication member configured to guide air introduced into an inner space of the first cyclone to the first fan;

a second communication member configured to guide air introduced into an inner space of the second cyclone to the second fan;

a first fan cover configured to accommodate the first fan therein, the first fan cover including:

a first air inlet formed in a direction of a rotation shaft of the first fan; and a first air outlet formed in a radius direction of the first fan; and a second fan cover configured to accommodate the second fan therein, the second fan cover including:

a second air inlet formed in a direction of a rotation shaft of the second fan; and a second air outlet formed in a radius direction of the second fan.

17. The robot cleaner of claim 16, wherein the first fan cover further includes a first exhaustion guide extending from an inner circumferential surface of the first fan cover, the first exhaustion guide having a rounded shape toward the first air outlet so that noise is reduced when dust-filtered air is discharged outside of the first fan cover, and wherein the second fan cover further includes a second exhaustion guide extending from an inner circumferential surface of the second fan cover, the second exhaustion guide having a rounded shape toward the second air outlet so that noise is reduced when dust-filtered air is discharged outside of the second fan cover.

18. A robot cleaner, comprising:

a suction unit configured to suck dust-contained air from a floor surface;

a cyclone unit provided rearwardly of the suction unit, the cyclone unit being configured to filter dust from the dust-contained air sucked into the cyclone unit through the suction unit, the cyclone comprising:

a first cyclone; and a second cyclone facing the first cyclone;

a dust box communicated with a dust discharge opening provided at a front side of the cyclone unit and configured to collect dust filtered by the cyclone unit; and a fan unit connected to the cyclone unit, the fan unit being configured to discharge dust-filtered air to an outside of the robot cleaner, wherein the cyclone unit is provided at a front upper side of the fan unit such that the dust box connected to the cyclone unit has a predetermined depth, and wherein the fan unit comprises:

a first fan configured to suck dust-filtered air and discharge the dust-filtered air to the outside, a second fan configured to suck dust-filtered air and discharge the dust-filtered air to the outside;

a first communication member configured to guide air introduced into an inner space of the first cyclone to the first fan; and a second communication member configured to guide air introduced into an inner space of the second cyclone to the second fan.

19. The robot cleaner of claim 18, wherein the fan unit further comprises:

a first fan cover configured to accommodate the first fan therein, the first fan cover including:

a first air inlet formed in a direction of a rotation shaft of the first fan; and a first air outlet formed in a radius direction of the first fan; and a second fan cover configured to accommodate the second fan therein, the second fan cover including:

a second air inlet formed in a direction of a rotation shaft of the second fan; and a second air outlet formed in a radius direction of the second fan.

* * * * *